US006896031B2

(12) United States Patent
Ratte

(10) Patent No.: US 6,896,031 B2
(45) Date of Patent: May 24, 2005

(54) APPARATUS AND METHOD OF FORMING PARTS

(75) Inventor: Robert W. Ratte, North Oaks, MN (US)

(73) Assignee: Water Gremlin Company, MN (US)

( * ) Notice: Subject to any disclaimer, the term of this patent is extended or adjusted under 35 U.S.C. 154(b) by 53 days.

(21) Appl. No.: 10/606,917

(22) Filed: Jun. 26, 2003

(65) Prior Publication Data

US 2004/0000387 A1 Jan. 1, 2004

Related U.S. Application Data

(63) Continuation of application No. 10/151,520, filed on May 16, 2002, now Pat. No. 6,598,658.

(51) Int. Cl.[7] ..... B22D 37/00
(52) U.S. Cl. ..... 164/133; 164/113; 164/120
(58) Field of Search ..... 164/133, 337, 164/113, 120, 312, 319

(56) References Cited

U.S. PATENT DOCUMENTS 6,598,658 B2 * 7/2003 Ratte ..... 164/133

* cited by examiner

*Primary Examiner*—Kiley Stoner
*Assistant Examiner*—I.-H. Lin
(74) *Attorney, Agent, or Firm*—Jacobson & Johnson

(57) ABSTRACT

A closed system and method that includes a source of pressurizeable molten lead connected to a mold having a mold cavity therein with the mold maintainable at sufficiently low temperature so that a charge of molten lead located in the mold cavity solidifies to thereby form a solidified casting in the mold cavity. A housing having a runner, is maintainable at sufficiently high temperature to maintain the molten lead in a molten state so that the mold cavity can be refilled with a fresh charge molten lead when a solidified casting is removed therefrom without introducing air to the closed system. A shut-off valve, having an open position to allow a charge of molten lead to flow into the mold cavity and a closed position to prevent molten lead from flowing out of the runner as the molten lead in mold cavity solidifies with the shut-off valve configurable to intensify the pressure of the lead in the mold cavity.

1 Claim, 9 Drawing Sheets

APPARATUS AND METHOD OF FORMING PARTS

CROSS REFERENCE TO RELATED APPLICATION

This application is a continuation of Ser. No. 10/151,520, filed on May 16, 2002, now Pat. No. 6,598,658, which was a division of Application Ser. No. 09/321,776; filed on May 27, 1999, now Pat. No. 6,405,786.

FIELD OF THE INVENTION

This invention relates generally to a closed system for pressure casting of lead articles and more specifically to pressure casting of lead and lead alloy parts while maintaining the supply of lead in a molten state without introducing air into the closed system even though a charge of molten lead is removed from one end of the system and a fresh charge of molten lead is introduced in the other end of the system.

BACKGROUND OF THE INVENTION

Battery terminals are a typical type of part that is made of lead or a lead alloy and are usually cold formed in order to produce a battery terminal that is free of voids and cracks. If lead or lead alloy battery terminals are pressure cast, air is left in the battery terminal cavity in the mold so that as the lead solidifies, the air bubbles prevent the battery terminal from cracking. That is, the air bubbles act as fillers so the lead remains distributed in a relatively uniform manner throughout the battery terminal. Unfortunately, if air bubbles that form within the battery terminal are too large or numerous it can cause the battery terminal to be rejected. In order to minimize the formation air bubbles in a battery terminal, a vacuum can be drawn in the battery terminal cavity mold. The vacuum removes air from the mold and inhibits the forming of air bubbles in the battery terminal, but the battery terminals cast using a vacuum in the battery terminal cavity oftentimes solidify in an uneven manner producing battery terminals with cracks or tears which makes the battery terminals unacceptable for use.

In a process of pressure intensification, which is shown and described in my copending patent applications Ser. No. 09/170,247 filed Oct. 13, 1998, Titled APPARATUS FOR AND METHOD OF PRESSURE CASTING BATTERY TERMINALS and Ser. No. 09/208,795 Filed Dec. 10, 1998 titled APPARATUS AND METHOD OF FORMING BATTERY PARTS, a battery terminal is cast which is substantially free of cracks and tears by pressure casting a lead alloy while a vacuum is being applied to the battery terminal cavity. After the lead is directed into the battery terminal cavity, a piston is driven into the mold to rapidly reduce the volume of the mold for solidification. By precisely controlling the time of application of an external compression force to the molten lead in the battery terminal cavity, and consequently, the time at which the volume of the battery terminal cavity is reduced, one can force the molten lead or lead alloy in the flowable state into a smaller volume where the pressure on the battery terminal cavity is maintained. By maintaining the pressure on the battery terminal cavity during or after the solidification process, the battery terminal can be cast in a form that is free of cracks and tears.

In the present process, the aforementioned process of intensification can be coupled with a closed system that allows one to maintain the molten lead in the runners in a molten condition. Through the selective use of slidable pistons that seal against the walls of their respective cylinders one can remove a charge of molten lead from the closed system and also introduce a fresh charge of molten lead to the closed system without introducing air into the system. The system can be used with mold cavities that are evacuated, mold cavities that have an air bleed passage or mold cavities that have no air bleed passage. One of the slidable pistons is used to both increase the pressure of the molten lead in the system and draw molten lead into the system and the other piston forms part of a shut-off valve that opens and closes the flow of molten lead into the mold. If the end of the slidable piston that forms part of the shut-off valve is driven into the runner in the mold, one intensifies or increases the pressure of the molten lead in the mold. In these mold cavities where the air has not been evacuated, one can produce cast parts with air pockets of sufficiently small size so as not to have an adverse effect on the use of the part.

SUMMARY OF THE INVENTION

Briefly, the present invention comprises a system for molding lead articles wherein the system is maintained in a closed condition to prevent air from entering the molten lead in the system. The system includes a mold having a mold cavity with the mold maintainable at sufficiently low temperature so that a charge of molten lead located in the mold cavity solidifies to thereby form a solidified casting in the mold cavity. A housing having a runner for the flow of molten lead therethrough connects the mold cavity to a source of pressurizeable molten lead with the runner maintainable at a sufficiently high temperature so as to continuously maintain the molten lead in a molten state so that the mold cavity can be refilled with a fresh charge of molten lead from the runner when a solidified casting is removed from the mold cavity. The system includes a shut-off valve, having an open position for allowing molten lead to flow into the mold cavity and a closed position to prevent molten lead from flowing out of the runner as the molten lead in the cavity solidifies, and if needed an intensification mode to momentarily increase the pressure of the lead in the mold cavity to thereby minimize shrinkage and the size of voids or air pockets in the casting. When the system is coupled to an immersion housing a fresh charge of lead can be introduced into the closed system without introducing air into the supply of molten lead.

DESCRIPTION OF THE PREFERRED EMBODIMENT

Figure 1:
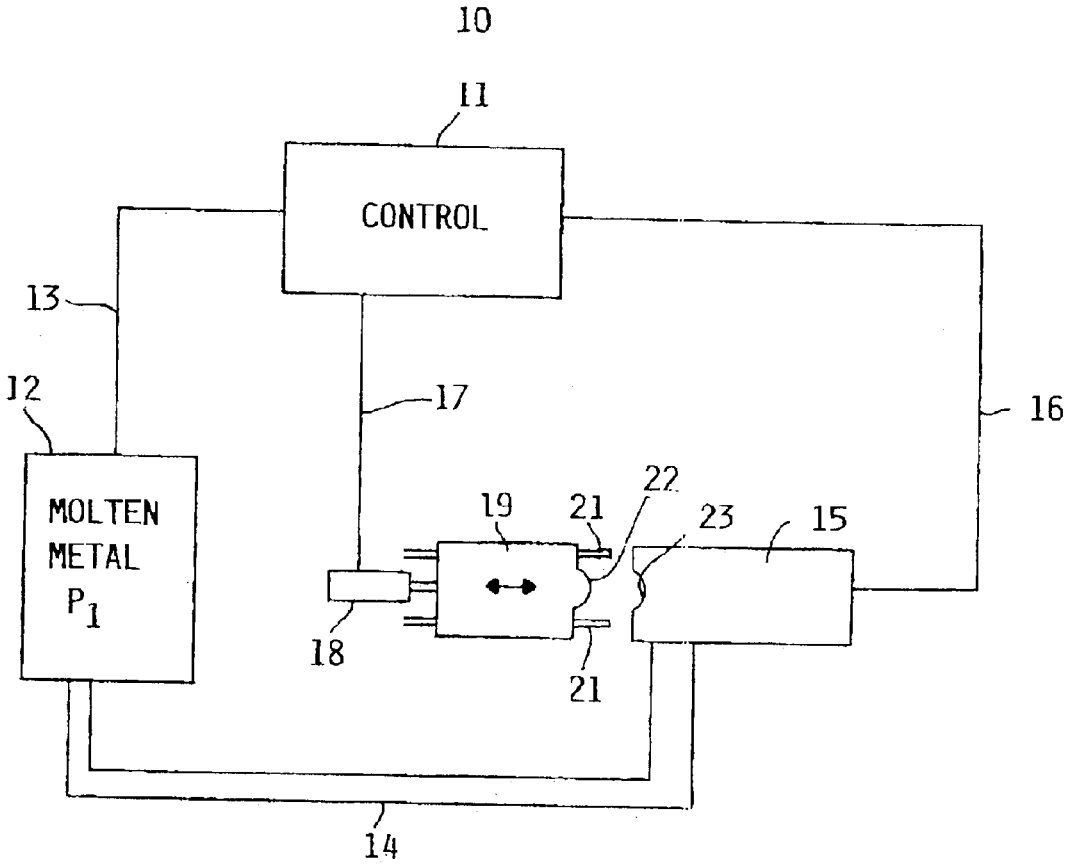
FIG. 1 shows a partial schematic of my closed system for pressure casting lead articles while maintaining the molten lead in a molten state.

FIG. 1 shows a partial schematic of my closed system 10 for pressure casting lead articles while maintaining the molten lead in the runners in a molten state. Closed system 10 for molding lead articles under pressure includes a source of pressurizeable molten lead 12, a control module 11, a runner 14 for directing molten lead to a housing 15 which includes a shut-off valve that controls the flow of molten lead into a mold 19. Control module 11, which may be a computer with appropriate software, connects to the source of molten lead 12 through a lead 13. Similarly, control module 11 connects to a power cylinder 18 through a lead 17. A third lead 16 connects control module 11 to a power cylinder located in housing 15.

Figure 2:
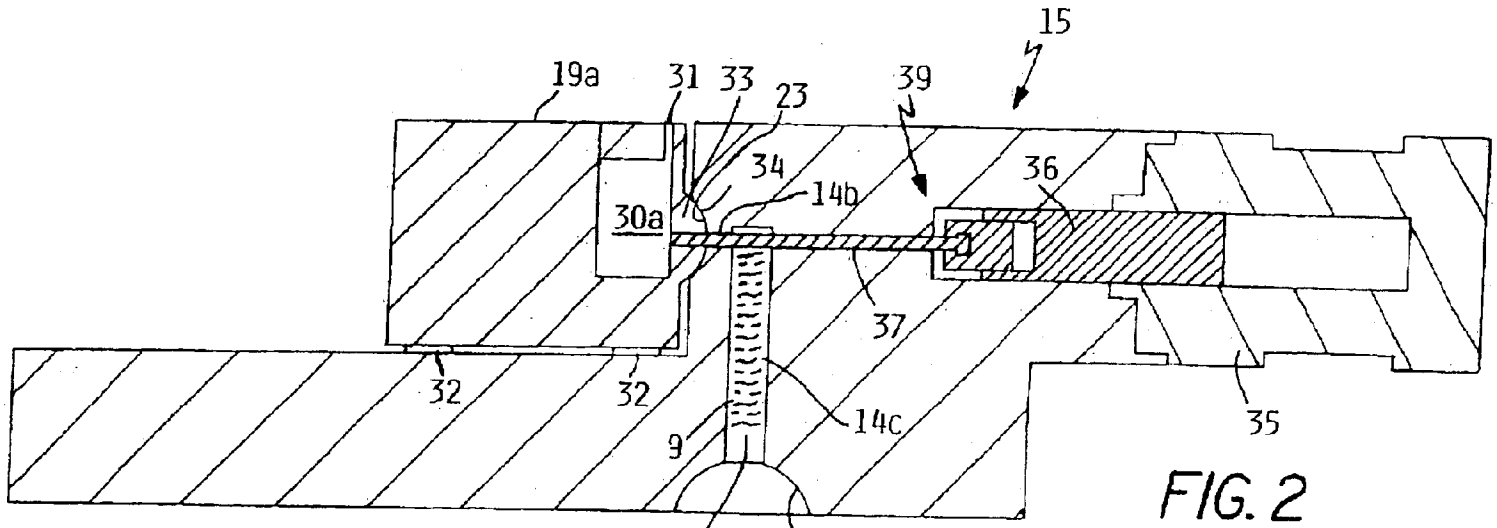
FIG. 2 shows a housing and a mold with a shut-off valve having a retractable member in a closed condition with a cavity in the mold housing to be filled with molten lead.

In the embodiment shown in FIG. 2, mold 19*a* includes a bleed chamber 31 for allowing air to escape from the mold cavity therein. Bleed chambers are known in the art and generally comprise a small necked passage that allows air to escape from the mold cavity as the molten lead is injected into the mold cavity. The passage has a small neck to allow air to escape but when lead enters the small necked bleed passage it quickly cools and solidifies thereby closing off the passage and preventing the escape of molten lead.

Mold 19 is shown mounted on a pair of rails 21 to permit one to slide mold 19 with connector 22 into temporary engagement with a connector 23 on housing 15 through a power cylinder 18. The embodiment as described in FIG. 1 with housing 15 in section is shown in further detail in FIGS. 5–9. In a further embodiment illustrated in FIGS. 2–4 the mold connector 22 remains in contact with connector 23 during the molding process.

With the closed system operation of the present invention, the molten lead is maintained in a molten state by having the housing 15, which is usually iron, at a temperature above the melting point of lead. This ensures that the molten lead therein will remain in a molten state. However, in order to cast a product, the mold 19 must be maintainable at sufficiently low temperature so that molten lead injected into mold 19 can solidify therein. In order to ensure that the mold is at sufficiently low temperature, either of two systems can be used to minimize heat transfer between the mold 19 and the housing 15. One system may be suitable for molds that can rapidly dissipate excess heat and the other system may be more suitable for molds that cannot dissipate heat as rapidly.

In the embodiment shown in FIG. 1 and FIGS. 5–9 the mold is temporarily maintained in contact with the housing 15 by sliding mold 15 away from housing 15 during a portion of the molding cycle thereby limiting the amount of conductive heat transfer from the housing 15 to mold 19 by limiting the time of contact between housing 15 and mold 19. In the embodiment shown in FIGS. 2–4 thermal insulation is used to thermally isolate the mold from the housing 15 to thereby limit the amount of heat transfer from housing 15 to mold 19.

Figure 3:
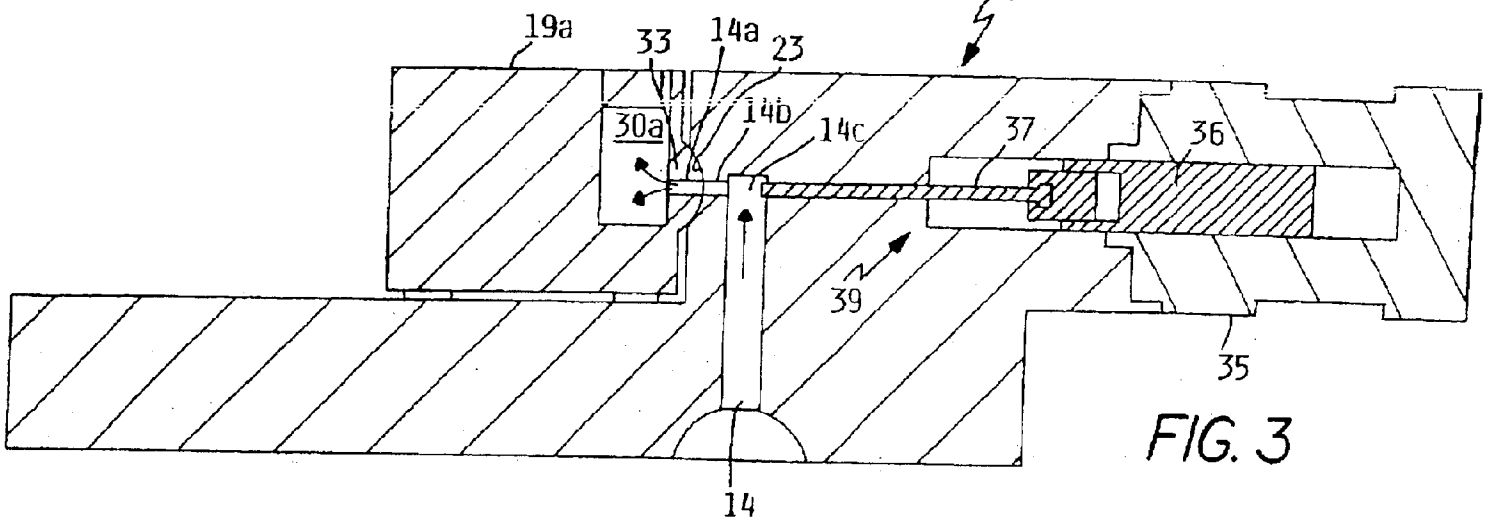
FIG. 3 shows a housing and mold of FIG. 2 with the retractable member in a open condition to allow a cavity in the mold housing to be filled with molten lead.
Figure 4:
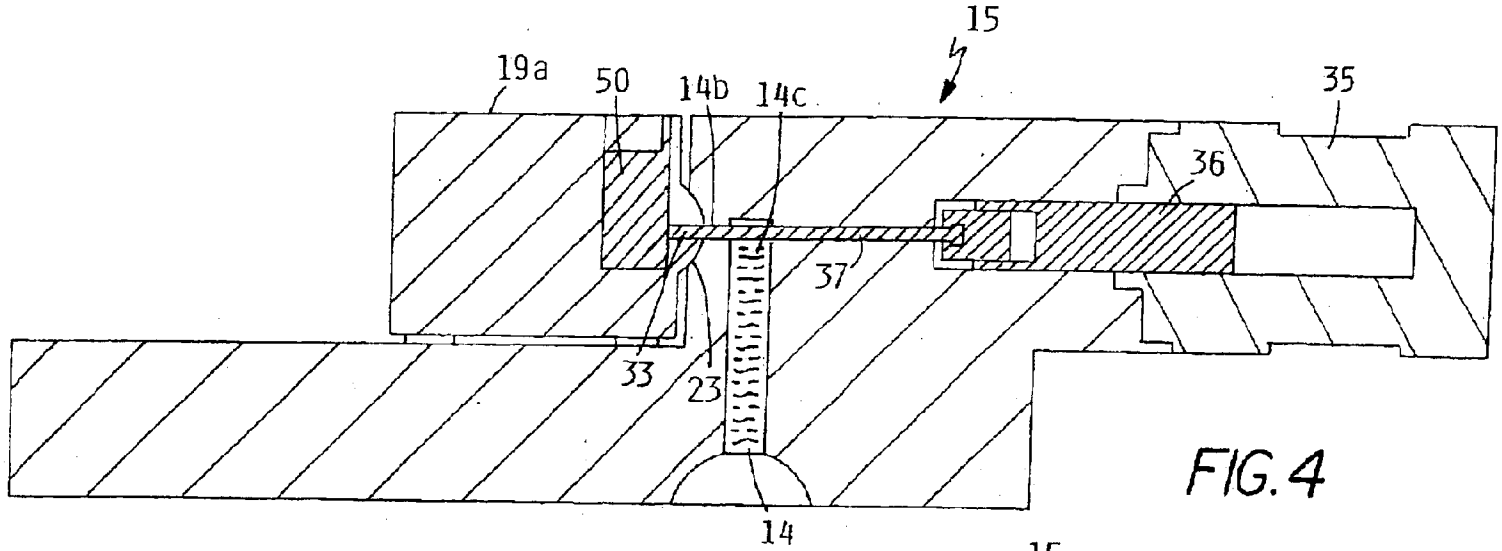
FIG. 4 shows a housing and mold of FIG. 2 with the retractable member in a closed condition and a solidified part in the mold cavity.

The housing 15 and mold 19*a* of an alternate embodiment are shown in cross-section in FIGS. 2–4. Mold 19*a* includes a mold cavity 30 with a bleed passage 31 connected thereto. Bleed passages are known in the art and are generally narrow passages that connect to the mold cavity to allow air to escape from the mold as the molten lead is injected into the mold. As the passage is narrow, the entrance of molten lead therein is quickly cooled thereby causing the passage to be blocked by the molten lead. If it is desired to have the cast part free of small air pockets, one can use an air bleed passage, on the other hand if small air pockets are acceptable in the cast part the bleed passage need not be used at all. Mold 19*a* is shown with connector 33 in engagement with connector 34 and the mold 19*a* thermally isolated from housing 15 by insulation pads 32.

Housing 15 includes a power cylinder 35 that includes a slidable piston 36 that can be powered in either direction by a signal from control module 11. Connected to slidable piston 36 is a cylindrical retractable and extendible member 37 that coacts with runner 14 to form a shut off valve 39 to control the injection of molten lead into mold cavity 30. Runner 14 is shown in FIG. 3 to include a cylindrical chamber 14*c*, a smaller cylindrical passage 14*b* located at a right angle to chamber 14*c* and a further cylindrical passage 14*a* located in mold 19*a* which connects to mold cavity 30. Housing 15 including shut off valve 39 are maintained at sufficiently high temperature through an external heat source (not shown) so that molten lead located therein will remain in the molten state.

Shut-off valve 39 has a closed position, which is illustrated in FIG. 2, to prevent molten lead from flowing out of runner 14 and an open position, which is illustrated in FIG. 3, for allowing molten lead to flow into mold cavity 30*a*. In the closed position as shown in FIG. 2, the slidable piston or cylindrical member 37 seals off runner passage 14*b* to prevent further molten lead from entering mold cavity 30*a*. The seal is obtained by a close tolerance fit between the outside diameter of member 37 and the inside diameter of runner passageway 14*b*. In the open position, which is shown in FIG. 3, the molten lead is allowed to flow through runner passage 14*c*, 14*b*, and 14*a* and into cavity 30*a* as indicated by the arrows. In this condition, the molten lead is injected under pressure into cavity 30*a* which is generated by a slidable piston in an immersion-housing 61. In order to provide smooth operation, the mold and the housing include mating members for providing a continuous inline passage between the mold cavity and the housing, and an alignment guide such as a beveled annular edge on either the end of cylindrical member 37 or the passageway 14*b* to ensure that any misalignment of the cylindrical member with the passageway is self correctable.

Figure 5:
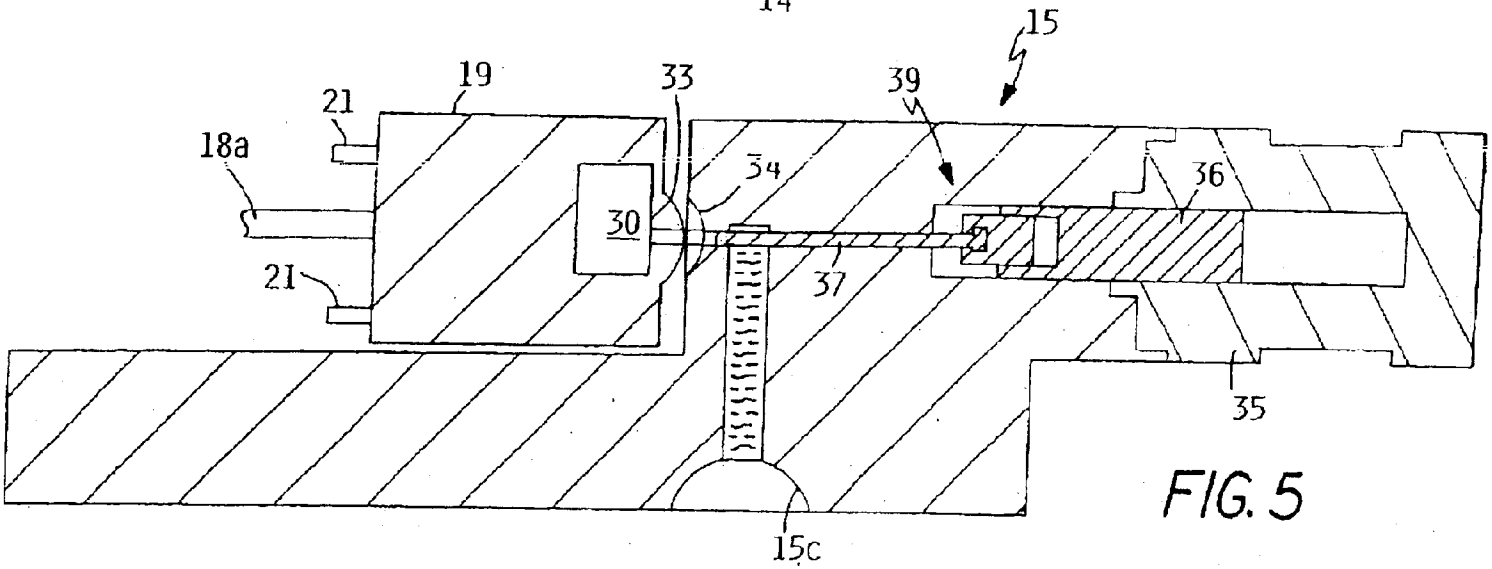
FIG. 5 shows an alternate embodiment of FIG. 2 wherein the mold is spaced from the housing as the molten lead solidifies.

FIGS. 5–9 show the embodiment wherein the mold 19 is slid into temporary engagement with the housing 15. Referring to FIG. 5, mold 19 is shown setting on rails 21 with mold 19 connected to an extension and retractable member 18*a* which is driven by the two way power cylinder 18 shown in FIG. 1. The mold 19 is shown without an air bleed passage. FIG. 5 shows the mold in a position to minimize heat transfer between housing 15 and mold 19. In this condition, connector 33 and connector 34 are in disengagement and mold 19 is spaced from housing 15 to thereby limit conduction heat transfer from housing 15 to mold 19. In this condition the cylinder member 37 is shown sealing the runner 14 to prevent molten lead from entering mold cavity 30.

Figure 6:
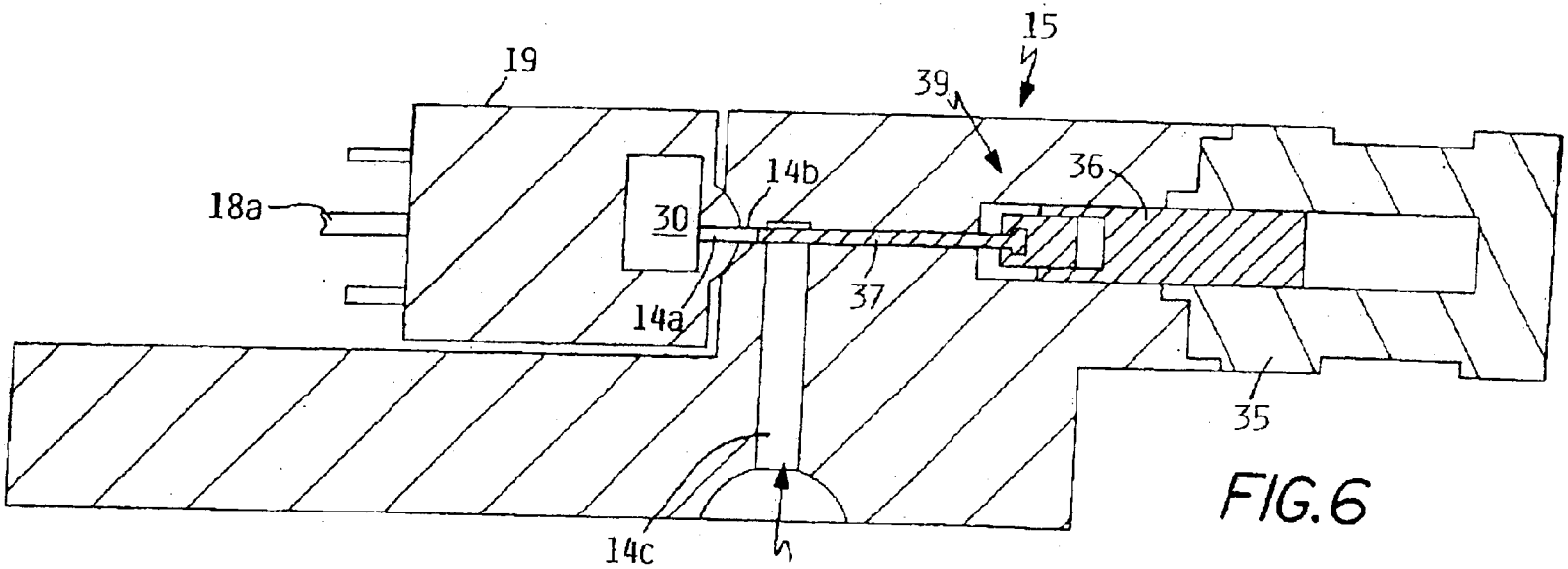
FIG. 6 shows the embodiment of FIG. 5 wherein the mold is engaged with the housing so that molten lead can be transferred to the mold.

FIG. 6 shows that mold 19 has been brought into engagement with housing 15 through extension of member 18*a*, which causes mold 19 to slide along rails 21. In this condition the mold cavity 30 is ready to receive molten lead through the runner 14*a*, however, the cylindrical member 37 is maintaining molten lead within the runner 14 by the close tolerance fit between cylindrical member 37 and cylindrical runner passage 14*b*. The step of closing the runner includes positioning piston 37 sufficiently far so as not to be in engagement with the mold but sufficiently far so as to maintain the piston in a blocking condition in the runner to thereby prevent molten lead from escaping from the runner.

Figure 7:
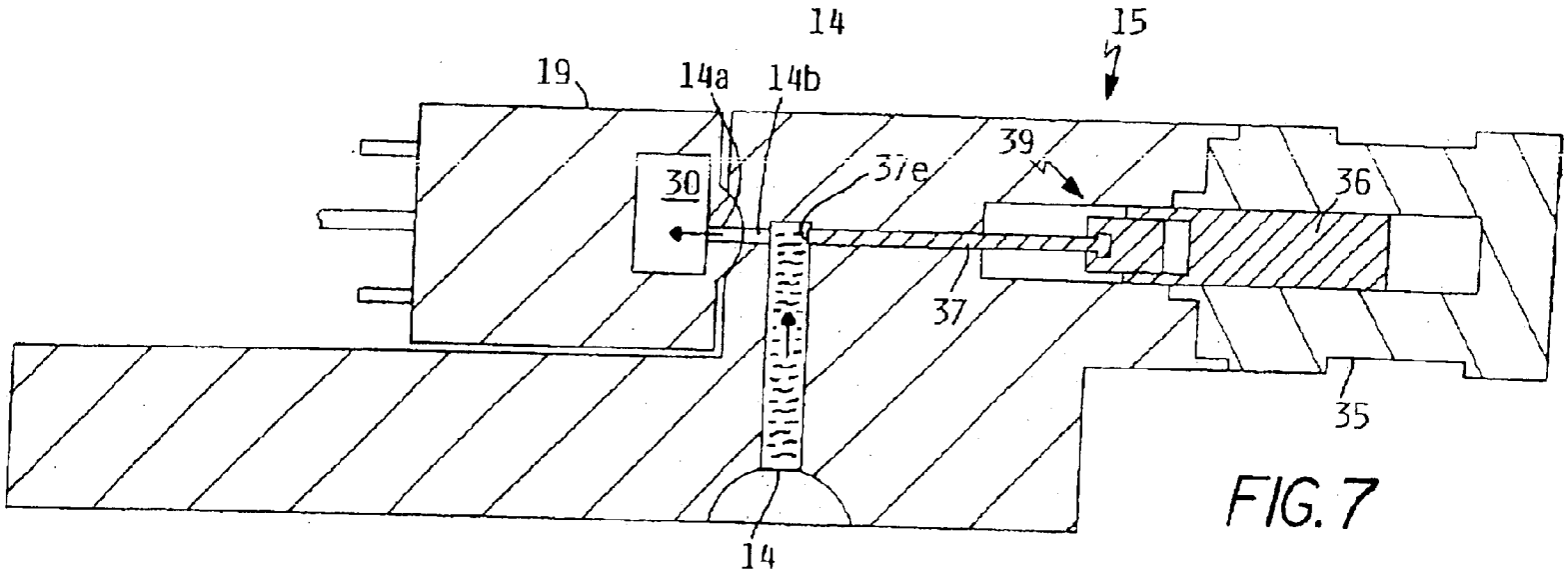
FIG. 7 shows the embodiment of FIG. 5 wherein the mold cavity is in fluid communication and physical contact with the housing and the retractable member is retracted to allow molten lead to flow into the mold cavity.

FIG. 7 shows shut-off valve 39 in the open position with the molten lead flowing into mold cavity 30. Note, the end 37*e* of cylindrical member 37 is positioned in a retracted condition so as not to block flow of molten lead into passage 14*b*.

Figure 8:
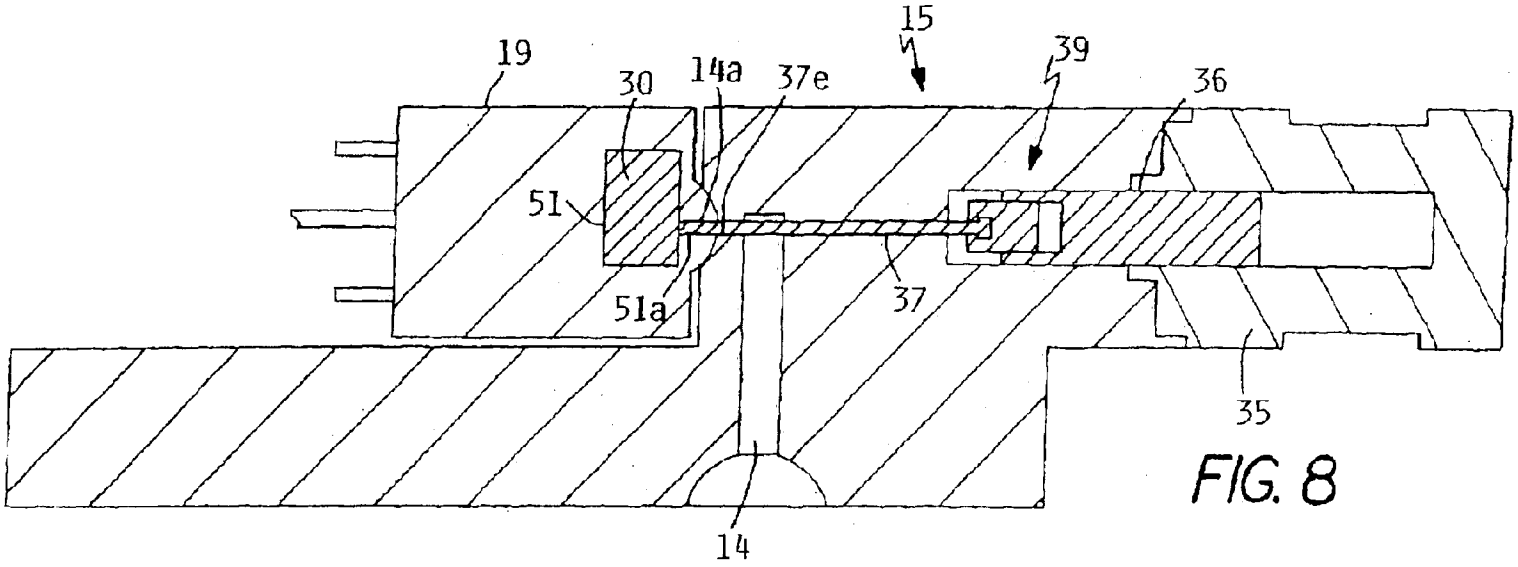
FIG. 8 shows the embodiment of FIG. 5 wherein the molten lead in the mold has solidified.
Figure 9:
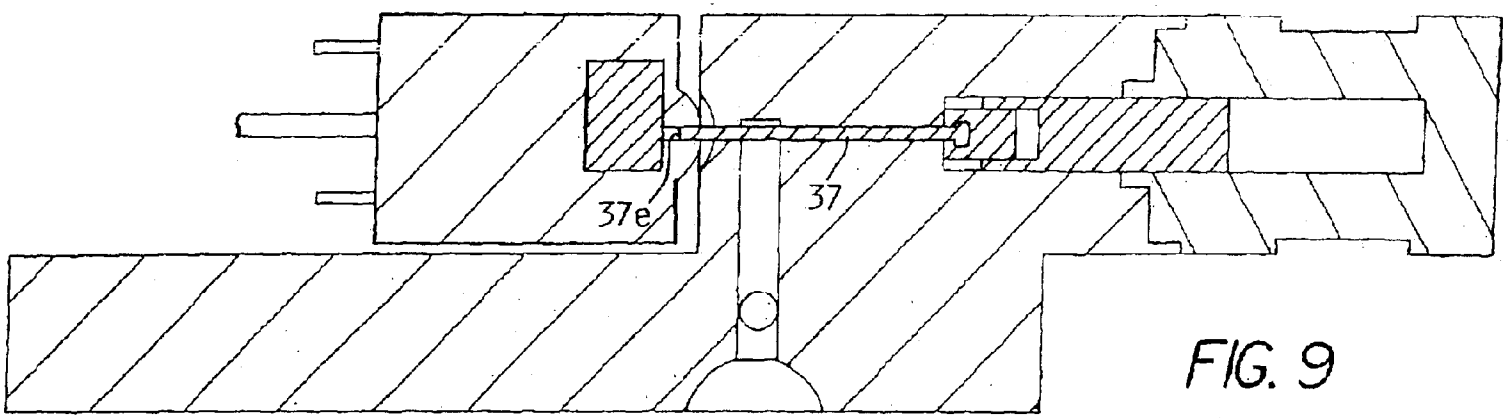
FIG. 9 shows the embodiment of FIG. 5 wherein the mold has been separated from the housing to minimize heat transfer to the mold from the housing.

FIG. 8 shows the shut-off valve 39 in the closed condition with end 37*e* extending into runner passage 14*b* to seal off the passage 14*b* and prevent further molten lead from flowing into cavity 30. The molten lead 51 is in a state of solidifying in cavity 30 and the lead 51 includes a neck 51*a* that extends into runner passage 14*a*. A feature of the present invention is that one can introduce the intensification process to the forming of the lead part in cavity 30. The intensification process is more fully described in my copending applications Ser. No. 09/170,247 filed Oct. 13, 1998, Titled APPARATUS FOR AND METHOD OF PRESSURE CASTING BATTERY TERMINALS and Ser. No. 09/208,795 filed Dec. 10, 1998 titled APPARATUS AND METHOD OF FORMING BATTERY PARTS which in its entirety is incorporated by reference herein.

In the intensification process, the state of molten lead is monitored so that when the molten lead enters a transformation stage from liquid-to-solid, the volume of the mold available for the lead to solidify therein is quickly reduced to thereby cause the molten lead to flow into the remaining volume while one maintains increased pressures on the molten lead. As the molten lead solidifies under the reduced volume and increased pressure, it produces a lead part that is substantially free of both tears and cracks. In still another variation of the process, the lead part is allowed to solidify in the mold, but before removal of the lead part from the mold a piston is driven into the lead part with sufficient force so as to at least partially cold form a portion of the lead part to thereby produce a lead part that is free of cracks and tears. Thus, it is apparent that with the present process of a closed system the cylindrical member 37*e* is configured to not only shut off the flow of molten lead but also can be driven into the solidifying lead in mold cavity 30 to increase or intensify the pressure to produce a lead part that is substantially free of both tears and cracks. Thus the shut-off valve can both control the flow of molten lead to the mold cavity and intensify the pressure of the lead in the mold.

While the transfer of molten lead from the runner 14 to the mold 19 had been described, the closed system also includes a source of pressurized lead 12. The source of pressurized lead is shown in FIGS. 10–13.

Figure 10:
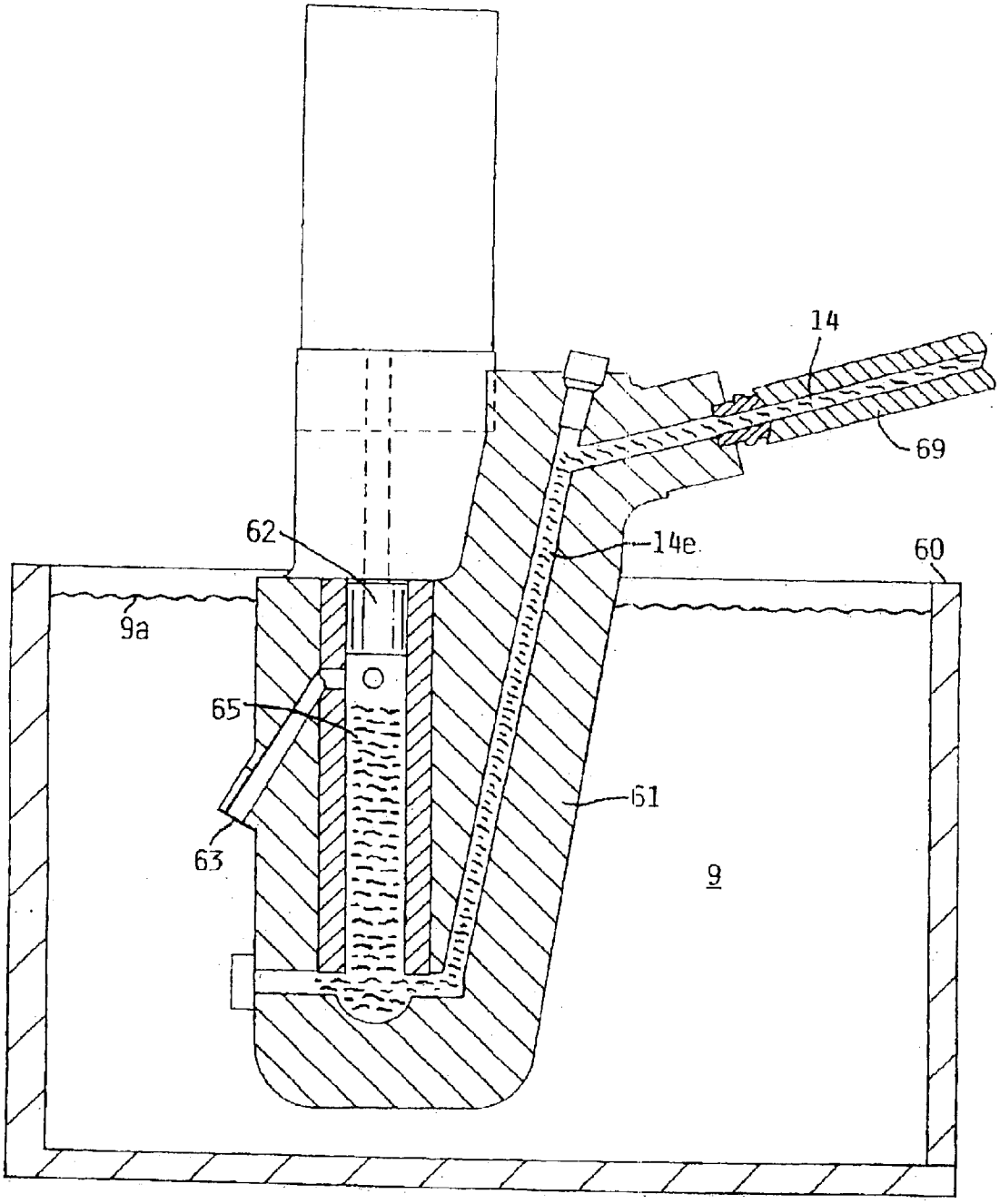
FIG. 10 shows a partial cross-sectional view of the mechanism for providing a source of pressurizeable lead located in an pre-pressurizing position.

FIG. 10 shows a source of pressurizeable molten lead 12 including a vat 60 of molten lead 9 having an immersion housing 61 therein with a slidable piston 62 for increasing the pressure of the molten lead in the immersion housing 61 and runner 14. The immersion housing 61 has an inlet 63 which is maintainable in the lower portion of the vat 60 of molten lead to prevent air from being drawn into the immersion housing when a fresh charge of molten lead is brought into the housing. That is the inlet 63 is located below the top 9*a* of the vat of molten lead. Immersion housing 61 is known in the art and is used to force lead from a vat of molten lead. In the present system, the immersion housing is coupled to the mold cavity through a closed system that enables a charge of lead to be removed from the system or added to the closed system without disrupting the condition of the molten lead in the system.

FIG. 10 shows the piston 62 at the beginning of the cycle with molten lead 9 located in chamber 65. As lead is substantially incompressible, the forcing of piston 62 downward forces molten lead trough runner passage 14*e* and runner 14. Runner 14 comprises a passage in a housing that is maintained at a temperature to maintain the lead in a molten state and provides an airtight passageway between immersion housing 61 and mold 19.

Figure 11:
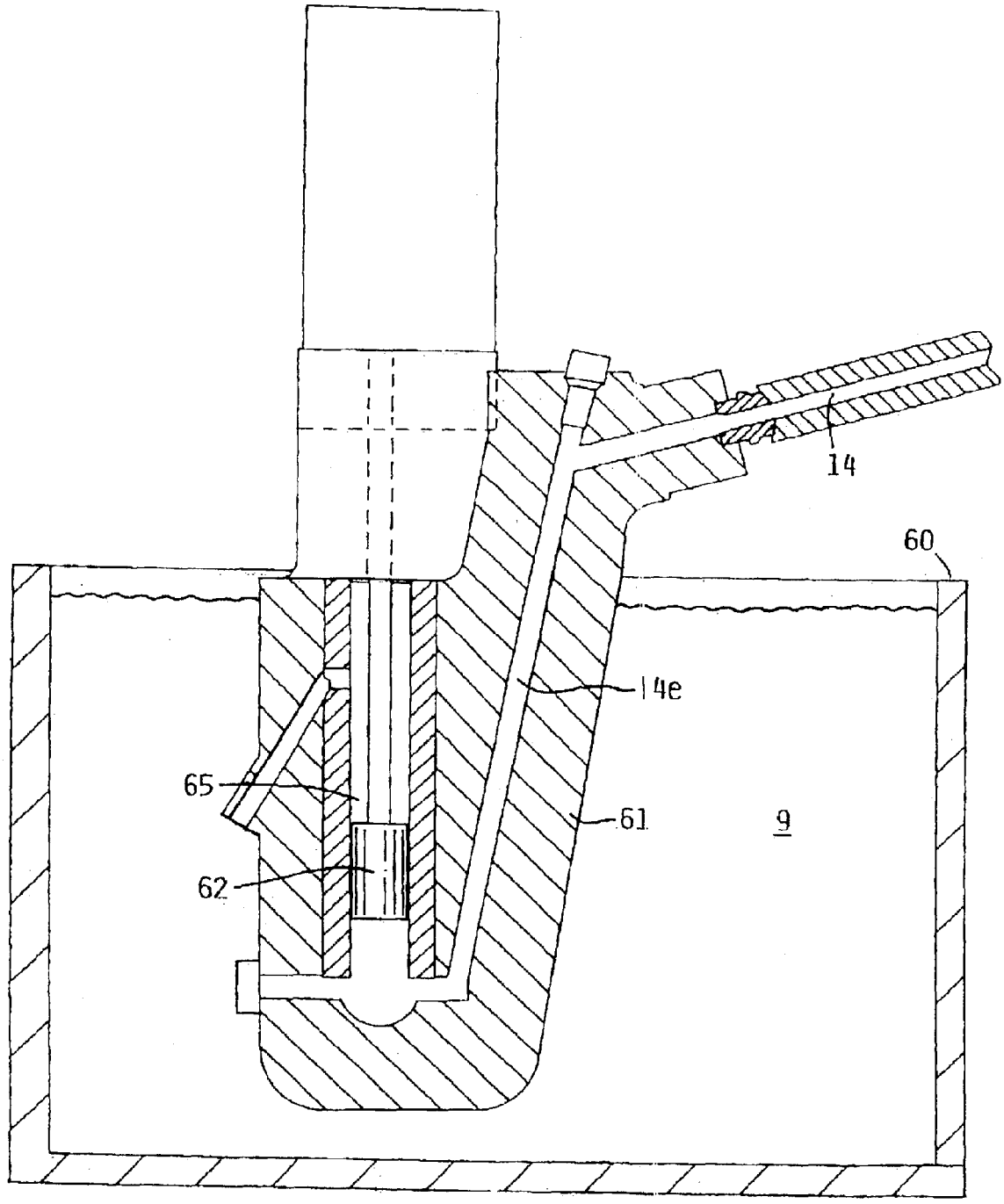
FIG. 11 shows a partial cross-sectional view of the mechanism for providing a source of pressurizeable lead located in the pressurizing position.

FIG. 11 shows piston 62 in the compressed position where the lead 9 in the runners 14 has been forced into the cavity of mold 19. After compressing the lead to the position shown in FIG. 11 the shut-off valve 35 is closed by extending cylindrical member 39 into the passage 14*b*. Consequently no air can get into the runners. By maintaining the appropriate pressure on the lead in the immersion housing, one can maintain the pressure of the lead in the runners at a fixed level.

Figure 12:
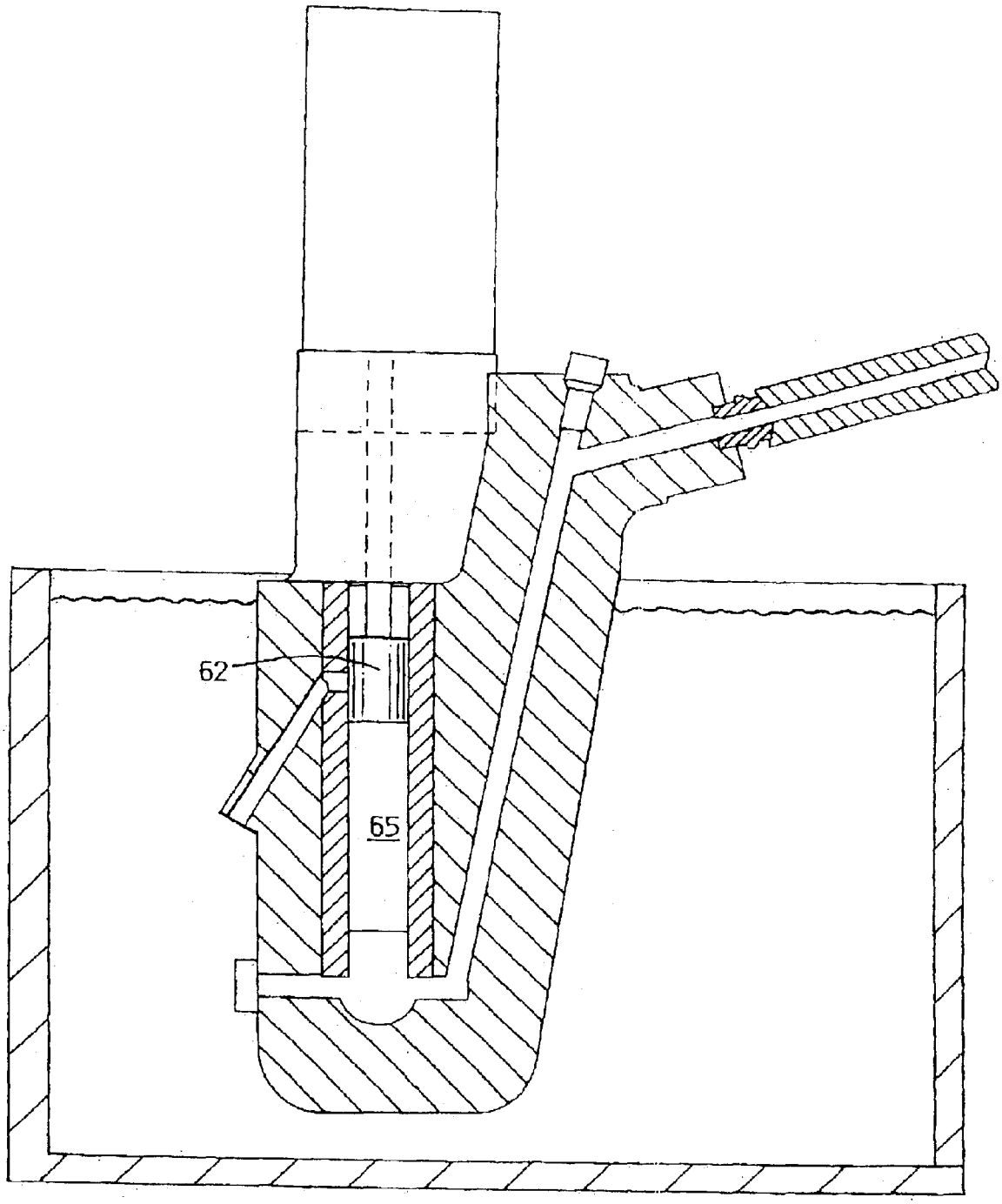
FIG. 12 shows a partial cross-sectional view of the mechanism for providing a source of pressurizeable lead located in a negative pressure position.

FIG. 12 illustrates what happens in the next step as the piston 62 is raised by a signal from the control module. As the piston is lifted upward, a vacuum is formed in the system. That is the runners now have a negative pressure as the piston 62 is brought upward to expand the volume of the system without introducing air or molten lead into the system.

Figure 13:
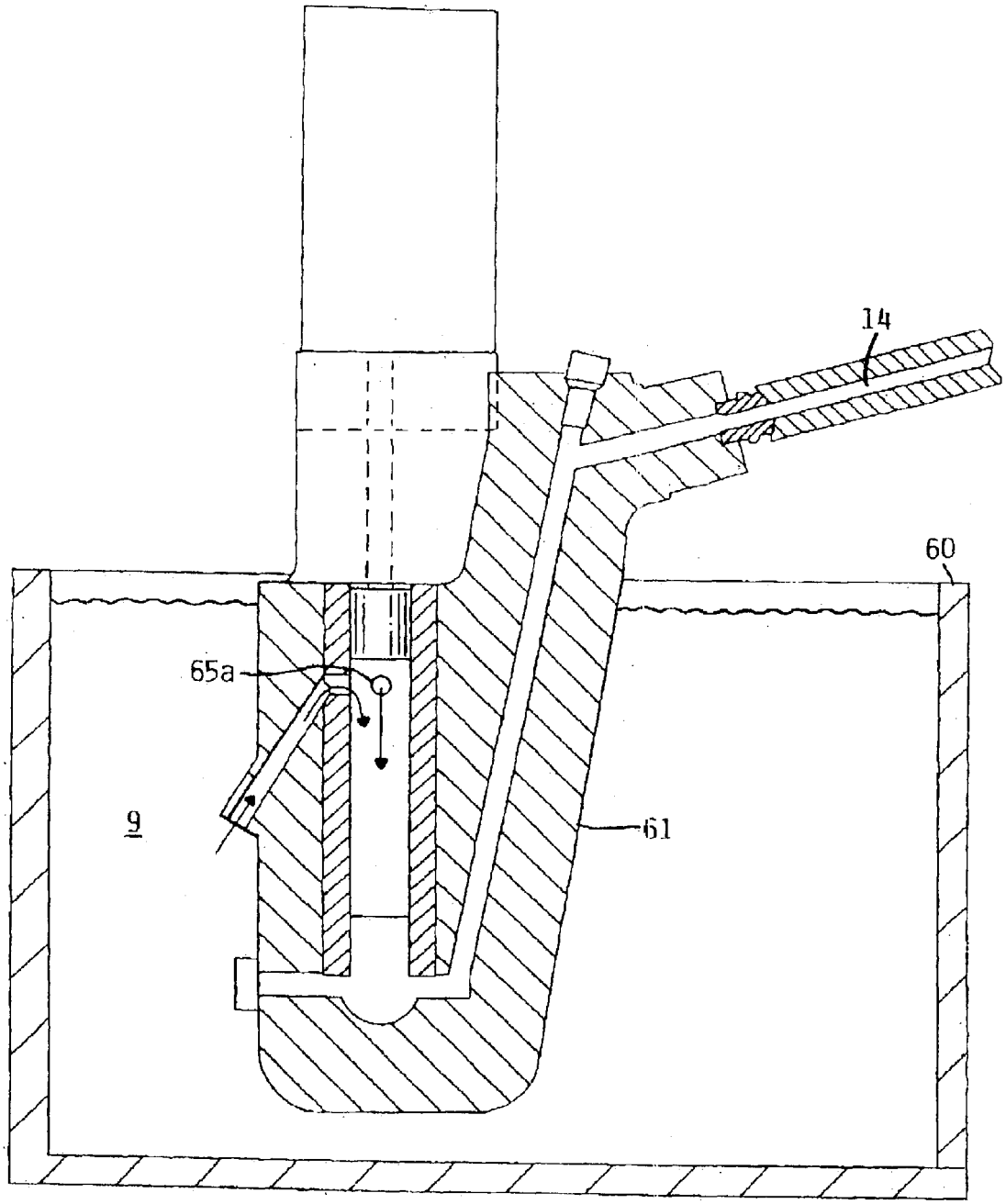
FIG. 13 shows a partial cross-sectional view of the mechanism for providing a source of pressurizeable lead located in a position for drawing a fresh charge of molten lead into the closed system.

FIG. 13 shows the piston drawn up slightly further to expose the inlets 65*a* which allows molten lead 9 to be drawn into chamber 65 through the vacuum within the system. In this condition the system has received a fresh charge of molten lead and is ready to force a charge of molten lead into the mold cavity.

Thus with the present system I have provided a method of pressure casting a lead article comprising the steps of 1) increasing the pressure of a source of molten lead sufficiently to force the molten lead to flow in a liquid state into a mold cavity 2) maintaining the mold cavity at a sufficiently low temperature so that when molten lead is injected therein the molten lead solidifies and 3) closing a runner to mold cavity 19 while maintaining molten lead 9 in a closed system to prevent entrapment of air in the molten lead so that a fresh charge of molten lead can be introduced into the closed system by retracting piston 62.

The closed system shown for molding lead articles without the introduction of air includes a control module 11 which can automatically control the sequence of system operations. The system further includes a source of pressurizeable molten lead 12 and a runner 14 that connects to a mold 19 having a mold cavity 30. The mold is maintainable at sufficiently low temperature so that a charge of molten lead located in mold cavity can quickly solidify to thereby form a solidified casting. In order to provide for continuous production of cast parts the housing 15 includes a runner 14 for flow of molten lead therethrough and for maintaining the lead in a molten state either through heating of the runner with an external heater or by maintaining insulation about the runner or housing. In either case, the runner is maintainable at sufficiently high temperature to continuously maintain molten lead therein in a molten state so that the mold cavity can be refilled with a fresh charge of molten lead from the runner when a solidified casting is removed. In order to start or stop the flow of molten lead to the mold, shut-off valve 39 has an open position that allows molten lead to flow into the mold cavity 30 and a closed position that prevents molten lead from flowing out of the runner 14. During the molding process as the lead in the mold cavity solidifies, one can intensify the pressure by driving cylinder member 37 of the shut-off valve 39 along the runner and toward the mold cavity to further increase the pressure in what is referred to as an intensification position. Once the molded part is released from the mold, the process is repeated.

It will be appreciated that with the present system not only can lead be maintained in a molten state, but that the entire system for handling the molten lead need not be built to withstand the pressure of intensification as only the mold experiences the high intensification pressures.

While the system has been described with respect to use with lead it is envisioned that the system can be used with other metals.

I claim:

1. The method of pressure casting a lead article comprising the steps of:

increasing the pressure of a source of molten lead sufficiently to force the molten lead to flow in a liquid state into a mold cavity;

maintaining the mold cavity at a sufficiently low temperature so that when molten lead is injected therein the molten lead solidifies therein;

closing a runner to said mold cavity while maintaining said molten lead in a closed system to prevent entrapment of air in the molten lead as a fresh charge of molten lead is introduced into the closed system; and removing a solidified casting from said mold cavity.

* * * * *